US005730201A

United States Patent [19]

Röllin et al.

[11] Patent Number: 5,730,201

[45] Date of Patent: Mar. 24, 1998

[54] OXIDE REMOVER

[75] Inventors: Erich Röllin; Hansjörg Huber, both of Neuhausen am Rheinfall; Jean-Pierre Gabathuler, Schleitheim, all of Switzerland

[73] Assignee: Alusuisse Technology & Management Ltd., Switzerland

[21] Appl. No.: 568,809

[22] Filed: Dec. 7, 1995

[30] Foreign Application Priority Data

Dec. 22, 1994 [CH] Switzerland ..... 03878/94

[51] Int. Cl.[6] ..... B22D 17/10; B22D 23/00

[52] U.S. Cl. ..... 164/113; 164/312; 164/900

[58] Field of Search ..... 164/900, 113, 164/312; 72/253.1, 255; 148/550

[56] References Cited

U.S. PATENT DOCUMENTS 4,056,964 11/1977 Shibasaki et al. ..... 72/255
4,687,042 8/1987 Young .
5,575,325 11/1996 Sugiura et al. ..... 164/900

FOREIGN PATENT DOCUMENTS 61-286050 12/1986 Japan ..... 164/312

OTHER PUBLICATIONS

Patent Abstracts of Japan, vol. 14, No. 69 (M-932) dated Feb. 8, 1990 for Japan Patent Publication 01-289556 dated Nov. 21, 1989.

Publication of Marcel Loher, Giesserei 78, 1991, No. 19, dated Sep. 16, 1991.

*Primary Examiner*—Kuang Y. Lin
*Attorney, Agent, or Firm*—Bachman & LaPointe, P.C.

[57] ABSTRACT

Process for manufacturing shaped parts out of thixotropic metal billets in horizontal pressure diecasting machines such that inclusions of oxide skin surrounding the thixotropic metal billet are avoided in the alloy structure of the shaped part. Before introducing the thixotropic metal alloy into the space inside the mould, the oxide skin surrounding the metal billet is removed completely and collected in a container such that removal of oxide-free, homogeneous thixotropic metal alloy is minimized by taking into account the thermal and mechanical properties of the thixotropic billet, which are asymmetric with respect to the longitudinal axis of the metal billet. The removal of the oxide skin takes place in a horizontal diecasting machine which contains an oxide remover between the casting chamber and the mold. The oxide remover is represented by a ring-shaped body with a horizontal concentric middle axis and a throughput opening. The oxide remover contains a ring-shaped recess, the oxide deposit ring which is connected to the throughput opening of the oxide remover via a concentric, ring-shaped oxide remover opening, the cross-section of the oxide remover opening being asymmetric with respect to the concentric middle axis of the oxide remover (30).

19 Claims, 4 Drawing Sheets

OXIDE REMOVER

BACKGROUND OF THE INVENTION

The present invention relates to a process for manufacturing shaped parts out of thixotropic metal billets in horizontal pressure diecasting machines such that inclusions of the oxide skin surrounding the thixotropic metal billet are avoided in the alloy structure of the shaped part. The invention also relates to a diecasting machine specially developed for carrying out the process according to the invention.

The process for manufacturing shaped parts out of thixotropic i.e. partially solid/partially liquid metal billets is known as thixoforming. Metal billets that come into question for the process are all billets that can be converted to a thixotropic state. In particular, these metal billets may be of aluminum, magnesium or zinc and alloys of these metals.

The thixoforming of thixotropic metal alloys is known. It is a process in which the thixotropic properties of partially solid and partially liquid metal alloys are exploited. In the following text the equivalent expression of semi-solid state is also used for the partially solid/partially liquid state i.e. thixotropic condition of metal alloys. By the thixotropic behavior of a metal alloy is understood that, when no force is applied, such a metal behaves like a solid body; if subjected to shear forces, however, its viscosity is reduced to such an extent that it behaves in a manner similar to that of liquid metal. To achieve this, it is necessary to heat the alloy up to the temperature zone for solidification between the liquidus and solidus temperatures. The temperature has to be adjusted such that e.g. a fraction of 20 to 80 wt % of the structure is molten while the rest remains in the solid state.

In the thixoforming process partially solid/partially liquid metal is transformed into shaped parts in a modified pressure diecasting machine. The pressure diecasting machines employed for thixocasting differ from those used for diecasting molten metal e.g. in that the former feature a longer casting chamber to accommodate the thixotropic metal billet and consequently a longer piston stroke and, for example, mechanical reinforcement of the parts of the die-casting machine that contact the thixotropic metal alloy, this because of the higher pressure on these parts during thixoforming.

Thixoforming is normally carried out using a horizontal pressure diecasting machine. In theses machines the casting chamber that accommodates the thixotropic metal billet lies horizontal, and is arranged at a right angle to the dividing plane of the mold, i.e. to the front face of the mold with the metal inlet opening. In the thixoforming process a thixotropic metal billet is loaded into such a horizontal casting chamber of a pressure diecasting chamber and introduced into the mold which is normally made of steel, in particular hot working steel, by applying pressure via a piston at high speed and at high pressure i.e. introduced and enclosed in the mold cavity where the metal alloy solidifies.

The as-cast structure formed during the solidification of the thixotropic metal alloy in the mold essentially determines the properties of the shaped part. The structure is characterized by phases such as parent metal and eutectic phases, the grain structure such as globulitic grains and dendrites, segregation and also defects in the structure such as porosity (gas pores, microvoids) and impurities such as e.g. oxides.

The semi-solid metal billets employed for thixoforming exhibit a fine grain structure which, provided no grain coarsening takes place during the pre-treatment of the thixotropic metal billet i.e. during heating up and transportation of the metal billet to the pressure diecasting machine, appears again in the alloy structure of the shaped part. Fine grain improves the material properties in general, increases the homogeneity of the alloy structure and helps to avoid defects in the structure of the shaped part. Thixoforming semi-solid alloys features other significant advantages over pressure diecasting of molten metal. One such advantage is the significant savings in energy and the shorter production times, this because the metal billets, in contrast to diecasting molten metal, have to be heated to lower temperatures and therefore undergo shorter heating up times, and also cool faster in the mold i.e. are returned to the solid state, which contributes to a reduction in grain growth. The energy saving is achieved mainly by the fact that a large fraction of the heat of fusion and all of the energy required for overheating is not required i.e. the additional heat supplied to the metal alloy to reach a temperature above the melting point in order to arrive at a molten state and the energy for keeping the melt hot is not necessary. A further advantage is the better dimensional tolerances due to the smaller amount of shrinkage and the production of parts that are closer to the final dimensions, as a result of which machining steps are reduced and alloy material is saved. Also, because of the approximately 100° C. lower manufacturing temperature, the individual components of the pressure diecasting machine are subjected to lower stresses due to thermal cycling, which means a longer service life of tooling. The lower processing temperature in thixoforming, compared with molten metal pressure diecasting, makes it possible to process alloys with a low iron content as this element is not taken up from the tooling by the alloy. Furthermore, thixoforming enables better filling of the mold cavity along with less entrapment of air.

On coming into contact with the surrounding atmosphere, items made e.g. of aluminum, magnesium or zinc, or their alloys acquire a natural oxide skin, the thickness of which is normally far below one micron. As a metal billet is heated up in order e.g. to transform it to a thixotropic state, this natural oxide layer, the so called oxide skin which is usually already present on the outside of the metal billet, becomes thicker. The thickness of the oxide skin formed during the heating up process depends on the heating up time required, on the atmosphere surrounding the billet and on the alloy composition of the billet in question. The thickness of the oxide skin formed during the heating process is, for aluminium billets, typically 0.1 to 10 μm. Especially in the case of metal alloys in the molten or thixotropic state impurities such as e.g. alkali and alkaline earth metals can gather in the oxide.

The oxides i.e. parts or particles of the oxide skin formed during heating are normally to be found again in the shaped parts. The oxide particles in the thixotropic metal alloy usually form e.g. oxide inclusions in the shaped part or lead to pores being formed in the alloy structure. Further, oxides and other non-metallic inclusions in the oxide skin can cause separation of the structure of the product. Consequently, the oxide skin on the surface of the thixotropic metal billet impair the quality of the shaped part and, as a result, its mechanical properties.

Oxide inclusions are therefore undesirable, especially in highly stressed parts, or may even prevent parts from being used as components that are exposed to high mechanical stresses.

A major problem in thixoforming thixotropic metal alloys is therefore the formation of oxide during pretreatments such as heating up or transportation of the metal billet through the surrounding atmosphere. The thickness of the oxide skin formed can be reduced, however not totally avoided, by taking special measures such as e.g. enclosing the metal billets in an inert gas. Also, the measures to be taken to reduce the thickness of oxide skin, especially when producing on an industrial scale, are involved and expensive.

SUMMARY OF THE INVENTION

In view of theses difficulties in thixoforming, the object of the present invention to minimize, at favorable cost, the structural defects in shaped parts caused by oxide inclusions and with that to provide a process for thixoforming which avoids inclusion of components of the oxide skin in the shaped parts.

That objective is achieved by way of the invention characterized in that, before introducing the thixotropic metal alloy into mold cavity, the oxide skin surrounding the metal billet is removed completely and collected in a container, the so-called oxide deposit ring, wherein removal of oxide-free, homogeneous thixotropic metal alloy is minimized by taking into account the thermal and mechanical properties of the thixotropic billet, which are asymmetric with respect to the longitudinal axis of the metal billet.

Consequently, shaped parts manufactured using the process according to the invention exhibit no oxide inclusions or only a small amount thereof, which is sub-critical with respect to the application intended for the shaped parts.

The amount of metal alloy required for carrying out the process for manufacturing the shaped part according to the invention is usefully present in billet form. The metal billets are cylindrical in shape and as a rule are round or oval in cross-section; they may, however, also be polygonal in cross-section. The diameter of the metal billet is for example 50 to 180 mm, usefully 75 to 150 mm and preferably 100 to 150 mm. The length of the metal billet is for example 80 to 500 mm.

Metal alloys that come into question for the process according to the invention are all commercially available metal alloys that can be converted to the thixotropic state. The process according to the invention is especially suitable for alloys of aluminum, magnesium or zinc. Especially preferred are aluminum casting and aluminum wrought alloys. The process according to the invention is, to advantage, also suitable for processing particle reinforced aluminum alloys containing e.g. homogeneously distributed SiC or $Al_2O_3$ particles. The process according to the invention is very specially suitable for aluminum alloys that exhibit a large solidification interval such as e.g. AlSi7 Mg.

BRIEF DESCRIPTION OF THE DRAWINGS

The present invention is explained in greater detail by way of examples with the aid of FIGS. 1 to 5.

DETAILED DESCRIPTION OF PREFERRED EMBODIMENTS

Figure 1:
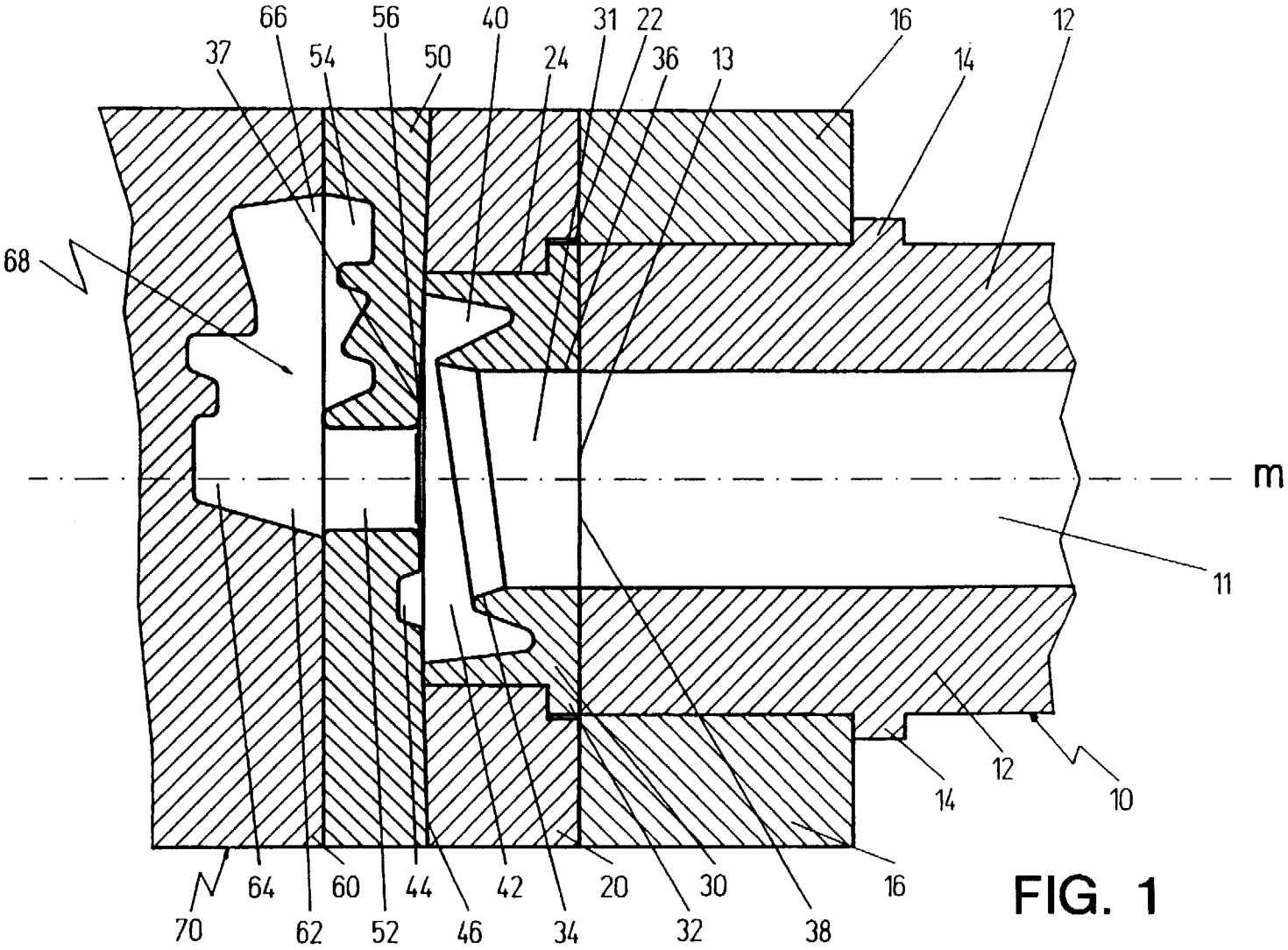
FIG. 1 shows part of a vertical, longitudinal section running through the middle axis of a horizontal diecasting machine.

The alloy of the metal billet necessary for the process according to the invention contains e.g. homogeneously distributed, primary particles from the solidification process, viz., from individual degenerated dendrites. Usefully, the fraction of primary solidified particles amounts to 40 wt % or more. In the case of aluminum alloys for example, it is necessary for the alpha phase to be present in globulitic form to achieve good thixotropic behavior so that the melt and solid fraction flow uniformly.

The degenerated dendrites in general preferably exhibit a globulitic form which enables uniform, homogeneous flow of melt and solid fraction to be achieved without precipitation taking place. A structure exhibiting globulitic dendrites is obtained by methods which include a continuous casting process combined with intensive electromagnetic stirring during solidification. This leads to melting and fracturing of dendrites which become rounded at temperatures close to the solidus, resulting in the globulitic structure.

For thermoforming purposes, the metal billet required for the process according to the invention is initially heated to a temperature which is above the solidus temperature and below the liquidus temperature i.e. until a semi-solid thixotropic condition is reached.

The heating of the metal billets usually takes place in a separate furnace, which may be heated using combustion materials such as e.g. gas or oil, or electrical energy e.g. by resistance or inductive heating. For the process according to the invention the metal billets are preferably heated in an induction heated furnace. The heating of the metal billets is very important as the state of the billet i.e. its partial strength is exhibited usually only in a very small temperature range; long heating up times have to be avoided e.g. because of the formation of a thick oxide skin or grain coarsening. Also, in order to achieve a homogeneous final product, the temperature distribution in the thixotropic billet, the so called thixo-blank, should be as homogeneous as possible. For that reason, the conversion of the metal billet to a thixotropic state i.e. the heating of the billet until the desired fraction of alloy is molten, is preferably carried out with the furnace temperature controlled by sensors.

The metal billets may be heated by loading them directly into a furnace, or they may be placed first in a container e.g. a metallic container, preferably of stainless steel, or in a crucible made of alumina-graphite or alumina-SiC. During the heating process the metal billets may be in the vertical or horizontal position with respect to their longitudinal axis. If a metal billet is heated in the horizontal position, it is housed e.g. in a container. When it has been converted to the thixotropic state, the metal billet may be transferred, e.g. by means of a gripping facility, into the casting chamber of the horizontal pressure diecasting machine and delivered for further processing into a shaped component. In this case the metal billet remains in the same container during the heating up process and during transportation in the casting chamber.

If the metal billet is loaded directly into the furnace for conversion to the thixotropic state i.e. without a container accommodating the billet, then the billet is preferably in the vertical position with respect to its longitudinal axis.

In the semi-solid state the thixotropic alloy contains a thixotropic paste-like structure comprising the solid, dendritic primary particles retarded in growth in a surrounding matrix of liquid metal. The fraction of solid, primary dendritic particles is usefully chosen such that during heating up, transportation to and in the casting chamber, the thixotropic metal billet does not undergo any significant deformation, and there is no significant loss of material, for example due to melt leaking out. The thixotropic, pasty structure contains preferably 40 to 80 wt. % of primary particles.

The thixo-blank is then pushed by a piston, effecting a thrusting action at the speed of the piston, through the throughput opening of a preferably ring-shaped body, the so called oxide remover, in which the oxide skin of the thixo-blank is, in accordance with the invention, removed and deposited in a container, the oxide deposit ring. The thixotropic metal alloy prepared in this manner is then passed through the inlet opening to the mold interior. The mold itself comprises normally of a fixed half and a moveable half, each half exhibiting a recess and the recesses of both mold halves together forming the interior of the mold, the so-called mold cavity, which may be at ambient pressure or be evacuated during the process according to the invention. During the heating up of the metal billet and its conversion to a thixo-blank, an essentially uniformly thick oxide skin is formed over the whole of the thixotropic metal billet. When thixoforming with a horizontal casting chamber, the metal billet is laid horizontal. For reasons relating to the process, the diameter of the metal billet is normally smaller than the diameter of the casting chamber interior. As the casting chamber interior is normally round or oval in cross-section, the thixotropic metal billet lying horizontal in the interior of the casting chamber rests on only a small area compared with its total surface area i.e. the thixotropic metal billet makes mechanical and thermal contact with the casting chamber wall over only a small area e.g. on its undermost side.

As the casting chamber is at a lower temperature than the thixotropic metal billet due to the direct thermal contact at the undermost side of the metal billet, more heat is transferred from the thixotropic metal billet to the casting chamber than from the other peripheral regions of the billet that make no direct mechanical and thermal contact with the casting chamber wall, where heat transfer to the wall takes place only via convection or thermal radiation. Depending how long the metal billet lies in the casting chamber, its mechanical properties i.e. in particular its partial strength or the viscosity may become inhomogeneous across the billet cross-section. If the temperature of the billet is initially in the temperature zone which permits the thixotropic state, then there is a danger that the surface on which the billet rests falls below the temperature required for the thixotropic state, and this part of the billet is then difficult to process.

For reasons relating to the process itself, the metal billet always cools faster at the surface on which it rests than the rest of the billet. Consequently, the semi-solid fraction or the viscosity in the region close to the contact area, is normally smaller than in the region close to the rest of the outer surface area. At least the viscosity of the metal alloy in the part of the thixotropic billet near the contact surface is higher than in the rest of the thixotropic metal billet. The semi-solid fraction in the interior of the thixo-blank does not however exhibit any noticeable variation. This semi-solid fraction corresponds essentially to that fraction in the part of the thixo-blank close to the outer areas, the surfaces of which make no direct mechanical or thermal contact with the casting chamber wall. Consequently, optimal removal of the oxide skin according to the present invention requires the asymmetric, with respect to the longitudinal axis of the metal billet, thermal and mechanical properties of the oxide skin and the region of thixotropic metal alloy close to the oxide skin to be taken into account. By optimal removal in the present text is to be understood removal of the oxide skin without simultaneously removing any :substantial amount of thixotropic alloy which is usable for thixoforming. In principle of course a larger concentric outer volume of the thixotropic metal billet may be removed so that only the core region of the thixo-blank is introduced into the interior of the mold. Even if this thixotropic material removed from the thixoforming process is recycled, the balance of such a procedure with respect to energy consumption and process costs is unfavourable, especially in the industrial production of such parts.

The inhomogeneous properties of the thixotropic metal billet, depending on the pre-treatment and time in the casting chamber, are not necessarily limited to the oxide skin. For that reason, in a preferred version of the process according to the invention, that part of the thixotropic metal billet close to the area on which the billet rests in the casting chamber and hence exhibits a smaller liquid fraction, is also removed during the removal of the oxide skin.

In a preferred version of the process according to the invention the thixotropic metal alloy is led through a ring-shaped body, the so called oxide remover, situated between the casting chamber and the mold as a result of which the oxide skin on the thixotropic metal billet is guided under mechanical flow through an inset concentric, ring-shaped opening, the so called oxide remover opening, the cross-section of which is asymmetric with respect to the concentric middle axis of the oxide remover, and from there into a ring-shaped oxide deposit ring.

Thereby, the ring-shaped oxide remover need not necessarily be a separate component of the pressure diecasting machine i.e. the ring-shaped oxide remover may also be an appropriately shaped part of the wall of the pressure diecasting machine surrounding the thixotropic metal alloy in the region between the casting chamber and the mold cavity.

The oxide remover may e.g. be a torus shape in the form of a torus-shaped oxide deposit ring which features a ring-shaped oxide remover opening pointing towards its concentric middle axis.

As the thickness of the oxide skin on the thixotropic metal billet is essentially constant all over, so also is preferably the amount of oxide removed over the whole peripheral region of the oxide remover, for which reason the cross-section of the oxide deposit ring is usefully axially symmetric with respect to its middle axis. The cross-sectional shape of the oxide deposit ring is non-essential for the process according to the invention and may have any desired shape i.e. an area enclosed by an essentially closed curve having an opening that is directed towards the concentric middle axis of the oxide deposit ring. On the other hand it is essential to the invention that, also when removing a constant amount of oxide over the whole peripheral region of the billet, i.e. a layer of constant thickness over the whole of the cylindrical, pasty surface region of the thixotropic alloy, the concentric ring-shaped oxide remover opening features an asymmetric cross-section with respect to its concentric middle axis, the cross-section of the opening, in particular in the lower part of the horizontal ring-shaped oxide remover, being larger e.g. than that of the upper part. This way account is taken e.g. of the higher viscosity of the metal alloy and oxide skin originating from that part of the thixotropic metal billet close to the area on which the billet rests in the casting chamber.

The cross-section of the oxide remover opening which is asymmetric with respect to the concentric middle axis (m) is preferably chosen as a function of the viscosity properties of the thixotropic metal alloy which are asymmetric with respect to this concentric middle axis (m), and chosen such that a radially uniformly thick layer of oxide skin and thixotropic metal alloy close to the oxide skin is removed.

Correspondingly, therefore, the removal of a radially uniformly thick layer of aluminum oxide and thixotropic metal alloy which exhibits different viscosity, essentially over the peripheral region of the thixo-blank i.e. the surface region of the pasty thixotropic alloy, is achieved by means of a ring-shaped oxide remover opening with an opening cross-section that is different according to the viscosity. In particular the cross-section of the opening in the lower part of the ring-shaped oxide remover is made larger in order to take into account the higher viscosity of the thixotropic metal originating from the region close to the contact surface on which the billet lies and the oxide skin.

In especially critical products the higher viscosity of the thixotropic metal alloy originating close to the contact surface may impair the quality of the alloy. For that reason in a further preferred process this part of the thixotropic metal alloy is removed along with the oxide skin, i.e. instead of removing a radially uniformly thick layer of aluminum oxide skin and thixotropic metal alloy, a thicker layer of thixotropic metal alloy is removed in the lower part of the oxide remover than in the upper part thereof. With this method more material is guided into the oxide deposit ring at the bottom. For that reason the part of the oxide deposit ring in question exhibits a larger cross-section, as a result of which the oxide deposit ring loses its axial symmetry.

In the present text the term lower or upper part of the oxide deposit ring is always to be understood the part with reference to a horizontal plane through the concentric middle axis of the oxide remover.

Very fast filing of the mold during the thixoforming process may cause turbulent flow conditions which lead to the entrapment of gases (air, mold separating or lubricating agents) in the product. Because of the different coefficients of thermal expansion of the metal alloy and the entrapped gas, this often prohibits any desired subsequent heat treatment of the part. Such entrapped gases lead to pores in the cast structure. Pore formation can be reduced by evacuating the mold cavity and/or by slower filling and extraction of air from the mold cavity. Slower filling i.e. filling of the mold cavity, aims at avoiding turbulence in the metal alloy, which necessitates special control of the rate of advance of the piston applying pressure to the billet. Essential here, for the process according to the invention, is that the removal of the oxide skin takes place continuously throughout the whole duration of the process, so that the material removed per unit time is proportional to the rate of advance of the thixotropic billet.

The pressure applied by the piston in order to fill the mold cavity during the thixoforming process is therefore chosen such that turbulence in the thixotropic metal alloy, and with that the formation of gas and oxide inclusions in the shaped part is avoided as much as possible, i.e. the pressure applied by the piston is preferably such that the thixotropic metal alloy with its surrounding oxide skin experience laminar flow conditions. The pressure applied by the piston to the thixo-blank is e.g. between 200 and 1500 bar, usefully between 500 and 1000 bar. The resultant rate of flow of the pasty thixotropic alloy is e.g. 0.2 to 3 m/s, usefully 0.3 to 2 m/s.

The high pressures applied during solidification improve metal feeding i.e. in order to ensure that the mold cavity is completely filled and reduce the amount of porosity due to shrinkage i.e. to avoid formation of so called microvoids. As the thixotropic metal alloy cools in the mold cavity, the density increases until the solidification point is reached. Shrinkage during solidification causes a high risk of defect formation and can lead to voids in the structure of the finished part. The deficit in volume due to solidification shrinkage may amount to 4 to 7.1%. Compensation for the solid state contraction that accompanies cooling after solidification is provided by the allowance for shrinkage made during production of the mold.

The shaped parts manufactured by the process according to the invention typically exhibit a porosity of less than 1 vol. % and an oxide fraction of e.g. 0 to 3 wt. %, preferably 0 to 1 wt. %. The process according to the invention, therefore, enables safety parts to be made by thixo-forming, the required high elongation properties being achieved e.g. by the combination of low iron alloys (<0.15 wt. % Fe), rapid solidification and avoiding oxide inclusions.

The invention also relates to a horizontal pressure diecasting machine for manufacturing shaped parts out of thixotropic metal billets such that inclusions in the oxide skin surrounding the thixotropic metal billet are avoided in the alloy structure of the shaped part, and the horizontal pressure diecasting machine features a horizontal casting chamber with a cylindrical shaped hollow interior to accommodate a thixotropic metal billet, a back-up plate with an opening, and a mold with inlet opening and mold cavity.

This is achieved by way of the invention in that an oxide remover is situated between the casting chamber and the mold, where the oxide remover represents a ring-shaped body with a horizontal, concentric middle axis and an outer and inner face, where the inner face forms the boundary of a thoughput opening, and the cross-section through the inner face of the oxide remover perpendicular to the concentric middle axis defines the cross-section of the throughput opening. The oxide remover contains a ring-shaped oxide deposit ring, which is connected via a concentric ring-shaped oxide remover opening to the throughput opening, where the cross-section of the oxide remover opening is asymmetric with respect to the concentric middle axis of the oxide remover.

During the process of filling the mold cavity, the oxide remover according to the invention acts as a peeling tool that peels off the oxide skin on the outside of the billet which is in a thixotropic state, and holds this oxide skin back in the oxide deposit ring of the oxide remover. The oxide remover is, therefore, usefully situated immediately upstream of the shape endowing tool i.e. the mold. In horizontal diecasting machines the billet container i.e. the casting chamber in which the semi-solid metal billet is laid, is horizontal. The casting chamber comprises essentially a cylindrical shaped body which is delimited by the casting chamber walls and is hollow inside, the so called interior of the casting chamber; the part of the casting chamber where the thixotropic metal billet is loaded into the chamber i.e. that end facing away from the mold, is e.g. half-shell shaped, while the end of the casting chamber facing the mold is in the shape of a closed cylinder, and the hollow space thus created is e.g. round, oval or polygonal in cross-section.

The diameter of the casting chamber is usefully equal to 102 to 120%, preferably 103 to 115% and, highly preferred, 103 to 110% of the diameter of the metal billet so that, after it has been loaded into the casting chamber, the thixotropic metal billet essentially makes mechanical and thermal contact with the casting chamber only at its undermost side.

The mold comprises e.g. a fixed mold half and a moveable mold half, each mold half featuring a recess which together form the interior of the mold, i.e., the mold cavity. The inlet for introducing the thixotropic metal alloy into the mold cavity usefully features an optimized cross-section with respect to the filling of the mold cavity, and is normally smaller than the cross-section of the opening in the casting chamber on the side facing the mold. As a result of the different cross-sections in the different zones (casting chamber, throughput opening, back-up plate opening, inlet opening of the mold, mold interior) through which the thixotropic metal alloy flows, the latter exercises different forces on the surrounding walls along the individual regions of the zones of flow, so that e.g. the resultant axial transmission of forces onto the walls of the different components of the horizontal diecasting machine differs. To accommodate a fraction of these axial forces i.e. forces acting in the direction of flow of the thixotropic metal alloy towards the mold, a back-up plate with opening in it is provide between the casting chamber and the mold.

Prior to thixoforming, the metal billets are cut to length according to the specific amount of material required, which is defined by the size of the mold cavity, and converted to the thixotropic state in a furnace, preferably an induction furnace, the essentially cylindrical shaped metal billets being held horizontal during the heating up process e.g. in a half-shell shaped, cylindrical container. Subsequently, the semi-solid metal billets are transferred, manually or by means of a manipulator, and loaded into the horizontal casting chamber. In order to prevent the metal billet from solidifying, the thixotropic metal billet must be transferred relatively quickly for further processing i.e. for example within one minute at most. In order to save energy and costs, the casting chamber is not normally heated, i.e. the metal billet cools down continuously, especially the area on which it rests in the casting chamber.

As the cylindrical shaped thixotropic metal billet usefully exhibits a smaller cross-section than the cylindrical and semi-cylindrical casting chamber, only a small area of it rests on the casting chamber wall. Because of the good thermal contact this area provides, i.e. due to direct conduction of heat, an inhomogeneous distribution of temperature is created in the thixotropic metal billet. If the thixotropic metal billet rests on a plurality of small area regions of the casting chamber wall distributed over the periphery of the billet, the metal billet, as a result of its own weight, exhibits better thermal contact at the areas of contact underneath it, so that more heat is released from the billet downwards than upwards. Consequently, the peripheral region of the billet that cools most is the undermost area where it makes contact with the casting chamber wall. As a result, the billet's thermal and mechanical axial symmetry, with respect to its concentric middle axis, achieved in the furnace is lost, which causes e.g. the viscosity or the liquid fraction of the thixotropic alloy to become asymmetric with respect to the concentric middle axis of the metal billet.

During the heating of the thixotropic metal billet and during transportation to the casting chamber, the natural oxide layer which is normally already present becomes much thicker as a result of the higher billet temperature in the semi-solid state and the more reactive billet surface this produces. The introduction of parts of particles of oxide skin into the mold cavity usually leads to significant defects in the casting or to the formation of pores there, as a result of which the alloy quality in the shaped part may be strongly impaired. Using the pressure diecasting machine according to the invention the oxide skin around the thixotropic metal billet can be completely removed by means of an oxide remover situated between the casting chamber and the mold. Thereby, as little as possible of the thixotropic metal alloy that is usable for the thixoforming process should be removed, which makes it necessary to take into account the asymmetric thermal and mechanical properties of the thixotropic metal billet i.e. asymmetric with respect to the concentric longitudinal axis of the metal billet.

In accordance with the invention the oxide remover comprises a ring-shaped body that features in the interior a concentric ring-shaped, for example torus-shaped recess, the so called oxide deposit ring. The inner part of the oxide remover or the part thereof representing the throughput opening i.e. the space defined by the inner face and both end faces of the oxide remover exhibits, perpendicular to the end faces, a concentric middle axis, the concentric middle axis of the oxide remover, that usefully coincides with the concentric longitudinal axis of the hollow interior of the casting chamber and in particular with the concentric middle axis of the mold inlet. The cross-section of the throughput opening perpendicular to the concentric middle axis of the oxide remover, the so called throughput cross-section, preferably corresponds to the cross-section of the opening in the casting chamber on the side facing the mold i.e. the opening in the cylindrical casting chamber facing the mold.

The end face of the oxide remover on the side facing the casting chamber is normally situated directly on the casting chamber opening on the side facing the mold. The end face of the oxide remover on the side facing the mold is preferably situated directly on the outer edge of the inlet leading to the mold cavity, i.e. the end of the oxide remover on the side facing the mold lies directly on the front side of the mold or on the fixed part thereof facing the oxide remover.

The oxide remover opening comprises a ring-shaped recess on the inner face of the oxide remover. It is preferably formed by a recess in the oxide remover on the side facing the mold i.e. it is situated on the end face of the oxide remover on the side facing the mold or on the side facing away from the casting chamber. As a result, a cylindrical mantle-shaped cavity is formed between the mold-facing end of the inner face and the oxide remover facing from side of the mold. A section along the middle axis (m) of the oxide remover through said mantle-shaped opening defines the corresponding opening diameter. The space formed by the opening between the throughput opening and the oxide deposit ring, the so called oxide remover opening, is in the shape of a hollow cylinder. The area cut out of the oxide remover opening by a longitudinal section through the concentric middle axis of the oxide remover represents the opening cross-section of the oxide remover opening.

For reasons relating to mechanical flow conditions the throughput opening may open conically outwards towards the end of the oxide remover on the side facing the mold. The wall of the conical increment makes an acute angle of e.g. 2° to 30°, preferably 5° to 15° and in particular 5° to 10° with the horizontal part of the inner face of the oxide remover, the details concerning angles in the present text always being based on a complete circle of 360°.

The oxide remover, casting chamber and the mold according to the invention are usefully of material that can be subjected to high thermal and mechanical loading, for example steel, in particular heat resistant steel (DIN X 38 CrMoV51), of ceramic materials or out of a steel with a ceramic coating on the surfaces exposed to the thixotropic metal alloy. Preferred is that at least the components of the pressure diecasting machine that come into contact with the thixotropic material, in particular the oxide remover, are made of heat resistant steel.

For reasons relating to mechanical flow, the front side of the mold, on the side facing the oxide remover, preferably features an inlet opening that tapers conically inwards, i.e. the inlet opening, usually leading through the fixed half of the mold, exhibits a strongly enlarging angle at the opening facing the oxide remover i.e. an opening angle that diverges only slightly from a right angle e.g. an angle of 80° to 87°.

At the front end of the inlet opening, i.e. where the thixotropic metal alloy, moving essentially parallel to the concentric middle axis of the inlet opening, impinges directly on the interior wall of the e.g. moveable mold half, this part of the mold may be provided with a recess which can accommodate the front side part of the oxide skin of the thixo- blank facing the mold.

In a preferred version of the pressure diecasting machine according to the invention, the oxide remover is situated in the back-up plate opening, whereby the length of the ring-shaped oxide remover usefully corresponds to the thickness of the back-up plate, i.e. the length of the back-up plate opening. Normally, during the thixoforming process, all parts of the pressure diecasting machine in contact with the thixotropic metal alloy are subjected to large forces acting in the direction of flow of the thixotropic alloy and, as a result of the oxide remover opening and the oxide deposit ring, the oxide remover exhibits a smaller wall thickness for example at its end facing the mold than at its end facing the casting chamber. For that reason, the oxide remover usefully features other means of taking up the forces acting on it in the direction of the mold. This may be achieved e.g. by means of a step on the oxide remover on the side facing the casting chamber, said step being made such that it engages in a groove-shaped recess in the back-up plate, thereby taking up the forces acting parallel to the concentric middle axis of the oxide remover in the direction of the mold. The groove-shaped recess and the step are preferably radially symmetrical, i.e. their cross-section perpendicular to the concentric middle axis of the oxide remover is preferably in the form of a circular ring.

The oxide deposit ring need, however, not necessarily constitute a separate component of the pressure diecasting machine; i.e. the ring-shaped body may also be a suitably shaped part of the wall of the pressure diecasting machine surrounding the thixotropic metal alloy in the region between the casting chamber and the mold cavity, or an appropriately shaped end of the casting chamber on the side facing the mold. The oxide remover is, however preferably a separately manufactured part that can be installed between the mold and the casting chamber.

If the oxide remover is in the form of a separate part of the diecasting machine, then it is usefully positioned between the casting chamber and the mold. This way the forces resulting from the pressure on the thixo-billet in the casting chamber are transferred in the axial direction onto the oxide remover. In order that the oxide remover is not overloaded, preferred means for accommodating these forces are provided on the back-up plate. This can be achieved e.g. by way of an integral or attached brace on the casting chamber wall and an integral or attached step in the form of a casting chamber alignment means for example on the outer region of the casting chamber. The casting chamber wall brace and the casting chamber alignment means are preferably ring-shaped, i.e. their cross-section perpendicular to the concentric middle axis of the oxide remover is preferably in the form of a circular ring.

Both the asymmetric cross-section of the oxide remover opening necessary for optimal removal of oxide skin, i.e. asymmetric with respect to the middle axis of the oxide remover, and the necessary optimum design and capacity of the oxide deposit ring, depend on the thickness of the oxide skin on the thixotropic metal billet and the size (length, diameter) of the metal billet. In turn, the thickness of the oxide skin depends to a large extent on the alloy composition and on the prehistory of the metal billet. The exact dimensions of the opening cross-section and the optimum shape and capacity of the oxide deposit ring must therefore be calculated in advance for the part to be made, and trials must be carried out before production.

The lower part of the oxide remover opening i.e. lower with respect to a horizontal plane through the concentric middle axis of the oxide remover, or at least a part thereof, i.e. in a segment of the hollow cylindrical oxide remover opening, preferably exhibits a larger opening cross-section than in the upper part. Thereby, the rest of the oxide remover opening, except this segment of the hollow cylindrical oxide remover opening, may be constant or become larger continuously or in steps towards the bottom. The cross-section in the lower lying segment of the hollow cylindrical oxide remover opening may likewise be constant or become larger continuously or in steps from top towards the bottom. The segment of the hollow cylindrical oxide remover opening with the larger cross-section concerns essentially that region of the oxide remover opening through which flows the oxide skin originating from, and the thixotropic metal alloy close to, the area on which the metal billet rests. The angle of segment in the hollow, cylindrical, oxide remover opening is preferably between 30° and 70° and in particular between 50° and 65°, with reference to a full circle of 360°.

Figure 2A:
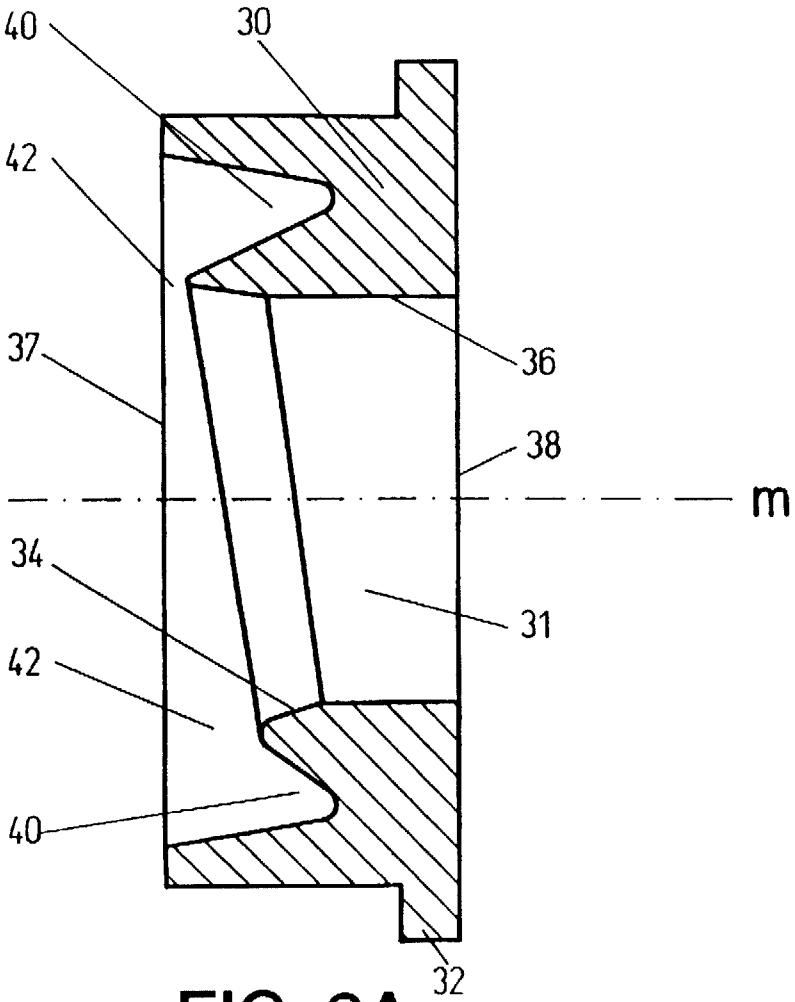
FIG. 2 shows a view of a vertical, longitudinal section running through the concentric middle axis of an oxide remover according to the invention, the oxide remover in FIG. 2*a* showing an oxide remover with an oxide deposit ring lying axially symmetrical to the concentric middle axis of the oxide remover and FIG. 2*b* showing an oxide remover with oxide deposit ring lying asymmetrical to the concentric middle axis.
Figure 2B:
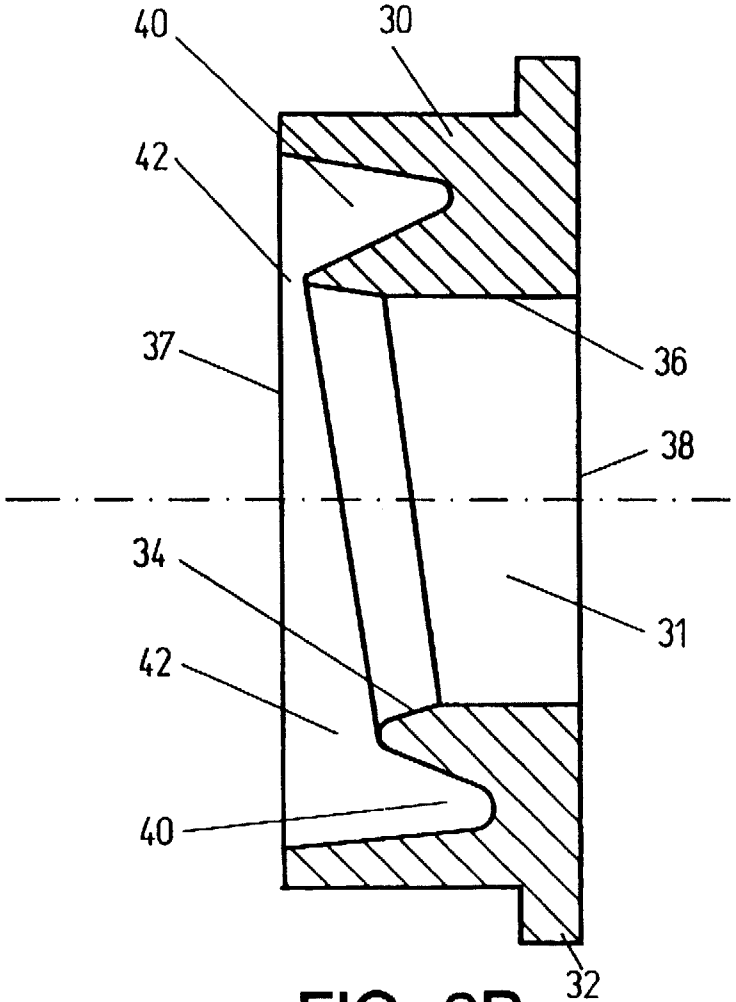

In an especially preferred version of the oxide remover according to the invention as shown in FIGS. 2a and 2b, the oxide remover opening is selected such that, in a vertical section along the middle axis (m) of the oxide remover, the upper part of the oxide remover opening exhibits an opening diameter of 0.5 to 4 mm, in particular, 1 to 3 mm, i.e., the uppermost opening diameter of the oxide remover opening measures 0.5 to 4 mm, in particular 1 to 3 mm.

In a further preferred version of the oxide remover according to the invention as shown in FIGS. 2a and 2b, the oxide remover opening is selected such that, in a vertical section along the middle axis (m) of the oxide remover, the lower part of the oxide remover opening exhibits an opening diameter of 1 to 10 mm, in particular 3 to 6 mm, i.e., the bottom opening diameter of the oxide remover opening measures 1 to 10 mm, in particular 3 to 6 mm.

In the case of an oxide remover opening on the mold-side end face of the oxide remover, the necessary asymmetric oxide remover opening according to the invention may be in the form of an appropriate recess in the front face of the mold on the side facing the oxide remover. The recess is preferably situated in the lower part of the oxide remover opening, i.e. lower with respect to the horizontal plane through the concentric middle axis of the oxide remover, and such that the cross-section in the lower part of the oxide remover opening i.e. in a segment of the hollow, cylindrical shaped oxide remover opening, is enlarged.

The asymmetric oxide remover of opening necessary for the uniform removal of oxide skin according to the invention i.e. asymmetric with respect to the concentric middle axis of the oxide remover may, accordingly., be achieved by a an oxide remover opening that is axially symmetric to the concentric middle axis of the oxide remover and features a recess according to the invention on the front side of the mold on the side facing the oxide remover. A corresponding recess on the front side of the mold on the side facing the oxide remover may, however, also be provided in addition to an oxide remover opening with a an opening cross-section that is already asymmetric with respect to the concentric middle axis of the oxide remover and thus enlarge the cross-section in this part of the oxide remover opening or serve to improve feeding of the oxide skin into the appropriate part of the oxide deposit ring.

The recess in the front side of the mold on the side facing the oxide remover may be of any desired shape, in particular a cylindrical shape, whereby cylindrical here means a space described by displacement of an area enclosed by any desired closed curve. The term cylindrical includes in particular also parallelepiped, cylinder-segment or hollow-cylinder-segment shaped recess. Further preferred shapes are barrel-shaped or blunted-pyramid shaped recesses. The spatial dimensions of the recess are preferably chosen such that the recess increases the cross-section of the oxide remover opening in the region where the oxide skin close to the area on which the metal billet rests is removed. Preferred shapes of recess exhibit, in the vertical plane through the concentric middle axis of the oxide remover, a maximum height of 10 to 40 mm, in particular 10 to 20 mm and a maximum width of 20 to 80 mm, in particular 20 to 50 mm and, in the direction towards the concentric middle axis, a maximum depth of 2 to 20 mm, in particular 2 to 8 mm. The recess also preferably exhibits a volume of 0.4 to 64 $cm^3$.

In order to remove an oxide skin of essentially constant thickness over the whole of the thixotropic metal alloy, an oxide deposit ring with axially symmetric cross-section is preferred i.e. axially symmetric with respect to the concentric middle axis of the oxide remover. The shape of the oxide deposit ring is non-essential. The oxide deposit ring may, for example, be a torus-shaped recess in the ring-shaped oxide remover with a ring-shaped oxide remover opening, whereby the torus-shaped recess may result from rotation of an area enclosed by any desired closed curve with an opening that is directed towards the axis of rotation around the concentric middle axis of the oxide remover. The concentric middle axis of the torus-shaped recess coincides therefore with the concentric middle axis of the oxide remover. The cross-section of the oxide deposit ring may be rectangular, circular or elliptic in shape. For process control purposes, the ring-shaped oxide deposit ring may additionally be divided by dividing walls into individual regions in order to improve the removal of the oxide skin.

The capacity of the oxide deposit ring, i.e. the volume of the torus-shaped recess is usefully chosen such that it is at least equal to the volume of oxide skin and any thixotropic metal alloy to be removed at the same time. The capacity of the oxide deposit ring is preferably between 1 and 10 vol. %, in particular 3 to 6 vol. % of the thixotropic metal billet, i.e. of the thixo-blank introduced into the casting chamber.

For reasons relating to mechanical flow behavior, in order to remove the oxide skin and the thixotropic metal alloy close to the oxide skin, i.e. the material to be removed, a particular thickness is required in order that the material to be removed, for example due to its viscosity and cohesion, is able to flow through the oxide remover opening. For that reason, in order to achieve continuous uniform removal, the pressure in the pasty thixotropic alloy, at least in the region of the oxide remover opening, should remain constant for a given oxide remover opening. Frequently, however, the pressure in the pasty thixotropic alloy with its surrounding oxide skin is not constant or at least not sufficiently constant.

In a preferred version of the horizontal diecasting machine according to the invention the oxide deposit ring comprises a plurality of ring-shaped recesses, the so called oxide deposit ring chambers, i.e. instead of only one single torus-shaped recess in the oxide remover, a plurality of torus-shaped recesses is provided, whereby the torus-shaped recesses are interconnected by a ring-shaped oxide remover opening. The capacity of the individual oxide deposit ring chambers may thereby be correspondingly smaller than when using a single torus-shaped recess. Especially preferred is for all the oxide deposit ring chambers of an oxide remover to form recesses on the mold side of the corresponding oxide remover.

Very highly preferred are oxide deposit ring chambers with reference to their shape, and individual oxide remover openings of the oxide deposit ring chambers, designed such that, with respect to the individual pressure built up in the thixotropic alloy during the thixoforming process or according to the pressure applied to the thixo-blank, they permit optimal removal of the oxide skin and the thixotropic metal alloy close to the oxide skin.

Especially preferred is for the oxide deposit ring to exhibit 1 to 5, in particular 3, oxide deposit ring chambers and a corresponding number of oxide removal openings. Thereby, each oxide deposit ring chamber, and the optimal cross-section of the corresponding oxide remover opening for filling this chamber, corresponds to a phase in which pressure is applied during the thixoforming process, each such phase of pressure application being selected such that, the resistance to filling, offered by the part of the mold cavity with the corresponding cross-section of the mold cavity to be filled throughout that phase, can be overcome.

Normally, it is necessary to have various phases of applying pressure in the thixoforming process. The first phase, e.g. the filling of the mold cavity, takes place under relatively low pressure. Following this, for example in order to complete the filling in the edge regions of the mold cavity, the pressure must be increased. The phase at which the highest pressure is applied in order to prevent microvoids or pores, is during solidification of the part. In this last phase there is no flow of metal forming the part and so no oxide skin has to be removed. In this last phase i.e. the solidification phase, thixotropic metal may flow but the amount of metal flowing is normally so small that it no longer reaches the space in the mold cavity where the part is formed and so is insignificant as far as the properties of the part are concerned. As the pressure applied according to the resistance to filling is increased continuously or in steps during the thixoforming process, the inner ring-shaped oxide removal openings exhibit a larger average cross-section than the outer oxide remover openings.

In order to achieve a better quality of alloy in the shaped part, the high viscosity thixotropic metal alloy from the region close to the area on which the billet rests, close to the oxide skin, can be removed along with the oxide skin. For that purpose it is necessary to provide an oxide deposit ring with a larger capacity in that region. In a further preferred form of oxide deposit ring at least a part of the lower part of the oxide deposit ring i.e. lower with respect to a horizontal plane through the concentric middle axis of the oxide remover, a larger cross-section than in the upper part, i.e. the oxide deposit ring exhibits asymmetry with respect to the concentric middle axis of the oxide remover. A longitudinal cross-section running vertically through the concentric middle axis of the oxide remover preferably exhibits in the lower half of the oxide remover, i.e. lower with respect to a horizontal plane through the middle axis, a one to three times, in particular a 1.1 to 1.8 times greater longitudinal cross-sectional area of oxide deposit ring than in the upper half of the oxide remover.

The horizontal pressure diecasting machine according to the invention is in principle suitable for thixoforming all metal alloys that can be converted to the thixotropic state and exhibit an oxide skin or form an oxide skin during pre-treatment, for example during heating up. The horizontal pressure diecasting machine according to the invention is preferably employed for thixoforming alloys of aluminum, magnesium or zinc. The horizontal pressure diecasting machine according to the invention is especially preferred and suitable for thixoforming aluminum diecasting alloys, in particular for AlSiMg, AlSiCu, AlMg, AlCuTi and AlCuZnMg alloys.

The horizontal pressure diecasting machine according to the invention permits therefore the optimal removal of oxide skin surrounding the thixo-blank shortly before filling the mold cavity and makes it possible therefore to produce shaped parts without inclusion of parts of the oxide skin. Furthermore, the horizontal pressure diecasting machine according to the invention enables a minimal loss of material i.e. thixotropic metal alloy that can be used for thixoforming purposes, to be achieved.

FIG. 1 shows, by way of example, part of a vertical, longitudinal section running through the middle axis of a horizontal diecasting machine, revealing the oxide remover part of the horizontal casting chamber 10, the oxide remover 30, the back-up plate 20 and the mold 70. The oxide remover 30 lies within the back-up plate opening 24, i.e. between the casting chamber 10 and the mold 70.

The casting chamber 10 features a space 11 which is enclosed by a cylindrical casting chamber wall 12 and serves to accommodate the thixotropic metal billet which is not shown here. The casting chamber space 11 represents essentially a cylindrical shaped body which is delimited by the wall 12. The casting chamber 10 is however surrounded by a closed cylindrical mantel, the casting chamber wall 12, only in the region of the casting chamber opening 13 on the side facing the mold and, on the side facing away from the mold, features a shell in the form of a half-cylinder, which is not shown here and is used for loading the thixotropic metal billet. The hollow casting chamber space 11 created by the walls 12 features for example a round, oval or polygonal cross-section. In the region of the casting chamber opening 13 on the side facing the mold the casting chamber 10 is therefore in the form of a hollow cylinder. The diameter of the casting chamber space 11 corresponds preferably to 103 to 115% of the diameter of the thixotropic metal billet, so that after it has been introduced into the casting chamber 10, the metal billet makes mechanical and thermal contact with the casting chamber wall 12 only at its undermost part. During the thixoforming process, a piston, not shown here, which is introduced into the end of the casting chamber 10 facing away from the mold 70, presses the thixotropic alloy under high pressure into the mold cavity 68 inside the mold 70. During the pressure diecasting process, the thixotropic metal billet is initially transported at high speed in the hollow cylindrical part of the casting chamber 10 whereby, at the latest after the metal billet meets the front side 46 of the mold 70 on the side of the oxide scraper, the thixotropic metal billet or thixo-blank loses its original shape and e.g. in the region of the casting chamber opening 13 fills the whole of the casting chamber space 11.

The mold 70 shown in FIG. 1 comprises a fixed mold half 50 and a moveable mold half 60, each mold half 50, 60 featuring a recess 54, 66 which together form the interior 68 of the mold 70. The inlet 52 for introducing the thixotropic metal alloy into the interior 68 of the mold 70 usefully features an optimized cross-section with respect to the filling of the mold cavity, and is smaller than then cross-section of the opening 13 in the casting chamber on the side facing the mold.

For reasons relating to metal flow behavior, the from side 46 of the mold 70 facing the oxide remover exhibits a part 56 that tapers conically inwards towards the inlet opening 52 i.e. the inlet opening passing through the fixed half 50 of the mold 70 exhibits, on the part 56 of the inlet opening 52 on the side facing the oxide remover, a pronouncedly enlarging opening angle i.e. an opening angle that deviates only slightly from a right angle.

At the front end of the inlet opening 52, i.e. where the thixotropic metal alloy running essentially parallel to the concentric middle axis m of the inlet opening 52 strikes directly against the wall of the mold space 66 in the moveable half 60 of the mold 70, there is also a recess 44, which can accommodate the oxide skin on the front side of the thixo-blank.

The oxide remover 30 is in the form of a ring-shaped body that features a concentric, ring-shaped, e.g. torus-shaped recess, the so called oxide deposit ring 40 on the inside. The inner part of the oxide remover 30 i.e. the space defined by the inner face 36 and both end faces 37, 38 of this body i.e. the throughput opening 31 of the oxide remover 30, features vertical to the end faces 37, 38 a concentric middle axis, the concentric middle axis m of the oxide scraper 30, which is coincident with the concentric longitudinal axis of the casting chamber space 11 and with the concentric middle axis of the inlet opening 52. The cross-section of the throughput opening 31 vertical to the concentric middle axis m of the oxide remover 30, the so called throughput cross-section, corresponds to the cross-section of the casting chamber 13 on the mold side, i.e. to the opening in the cylindrical casting chamber 10 facing the mold.

The end face 38 on the casting chamber side of the oxide remover 30 is situated directly on opening 13 of the casting chamber on the side facing the mold. The end face 37 of the oxide remover on the side facing the mold is situated directly at the outermost edge of the opening 52 leading to the interior of the mold or on its conical inlet opening 56 i.e. side 37 of the oxide remover 30 facing the mold lies directly on the front side 46 of the mold that faces the oxide remover 30 or on the fixed half 50 of the mold.

The oxide remover opening 42 is represented by a ring-shaped recess in the inner face 36 of the oxide remover 30. It is formed by a recess in the oxide remover 30 i.e. it is situated on the end face 37 on the side facing the mold or on the side of the oxide remover 30 facing away from the casting chamber 10. As a result a cylindrical shaped space is provided between the end of the inner face 36 on the side facing the mold and the front side 46 of the mold 70 on the side facing the oxide remover 30, so that the space provided, i.e. the oxide remover opening 42, created by this opening between the throughput opening 31 of the oxide remover 30 and the oxide deposit ring 40, is in the form of a hollow cylinder. The area of the hollow cylinder formed by a longitudinal section through the concentric middle axis m of the oxide remover 30 represents the cross-sectional opening of the oxide remover opening 42. The throughput opening 31 of the oxide remover 30 increases conically towards the end face 37 of the oxide remover on the side facing the mold, as a result of which a conical increment 34 is formed. Shown in the lower part of the fixed mold half 50 in FIG. 1 is also a recess 44 which increases the cross-section of the oxide remover opening 42 in that region.

In order to accommodate the forces acting in the axial direction i.e. in the direction of flow of the thixotropic metal alloy towards the mold 70, a back-up plate 20 with opening 24 is provided between the casting chamber 10 and the mold 70. The oxide remover 30 is situated in the back-up plate opening 24, the length of the ring-shaped oxide remover 30 corresponds to the thickness of the back-up plate 20 i.e. the length of the back-up plate opening 24. Normally, during the thixoforming process, high forces acting in the direction of flow of the thixotropic metal alloy arise in all parts 12, 30, 70 of the diecasting machine that contact and guide the thixotropic alloy. Also, as a result of the oxide remover opening 42 and the oxide deposit ring 40, the oxide remover 30 exhibits a smaller wall thickness in that region than at its end 38 facing the casting chamber. For that reason, the oxide remover 30 exhibits, on the side 38 facing the casting chamber, an integral step 32 which is designed such that it engages in a groove shaped recess 22 in the back-up plate 20, thus taking up a some of the forces acting parallel to the concentric middle axis m of the oxide remover in the direction of the mold 70. The groove shaped recess 22 and the integral step 32 are radially symmetrical i.e. their cross-section perpendicular to the concentric middle axis m of the oxide remover 30 is circular in shape.

In order to reduce the transfer of axial forces from the casting chamber 10 to the oxide remover 30, a casting chamber mantel 16 is provided either as an integral component or mounted thereon. A step in the form of an alignment means 14 for the casting chamber is provided attached to, or as an integral part of, the casting chamber 10 at its outermost peripheral region and a distance from the mold-facing end of the casting chamber opening 13 corresponding to the length of the mantel 16. The casting chamber mantel 16 and the casting chamber alignment means 14 are ring-shaped i.e. their cross-section perpendicular to the concentric middle axis m of the oxide remover 30 is circular. The inner diameter of the ring-shaped casting chamber mantel 16 corresponds essentially to the outer diameter of the casting chamber wall 12, and the outer diameter of the casting chamber alignment means 14 is larger than the inner diameter of the casting chamber mantel 16.

FIG. 2*a* shows a view of a vertical longitudinal cross-section through the concentric middle axis m of the oxide remover according to the invention, where the oxide remover 30 features an oxide deposit ring 40 lying axially symmetrical to the concentric middle axis m. The lower part of the oxide remover opening 42, i.e. lower with respect to a horizontal plane through the concentric middle axis m, features, at least in a part thereof, i.e. in a segment of the hollow cylinder shaped opening 42 in the oxide remover 30, a larger cross-section of opening than in the upper part. Up to this segment of the hollow cylinder shaped opening, the cross-section of the opening may be constant or be enlarged either stepwise or continuously towards the bottom. The cross-section of the opening in the lower lying segment of the hollow cylinder-shaped oxide remover opening 42 with the larger cross-section may likewise be constant or increase continuously or in steps downwards. As such the segment of the hollow cylinder-shaped oxide remover opening 42 with the larger cross-section concerns essentially the region of the opening 42 through which flows the part of the oxide skin and the thixotropic metal alloy originating from the region close to the areas on which the thixotropic metal alloy rests.

The throughput opening 31 is enlarged forming a conical increment 34 towards the end face 37 of the oxide remover 30 facing the mold and allows the oxide skin and the metal alloy lying close to the oxide skin to flow better into the oxide deposit ring.

The oxide deposit ring 40 shown in FIG. 2*a* is axially symmetric to the concentric middle axis m of the oxide remover and is suitable for removing an oxide skin of essentially constant thickness over the whole periphery of the thixotropic metal alloy. The cross-section of oxide deposit ring shown in FIG. 2*a* displays particularly good properties with respect to guiding the oxide skin and the thixotropic metal alloy close to the oxide skin.

FIG. 2*a* shows a view of a vertical longitudinal cross-section through the concentric middle axis m of the oxide remover 30 according to the invention, where the oxide remover 30 features an oxide deposit ring 40 lying axially asymmetrical to the concentric middle axis m. The lower part of the oxide deposit ring 40, i.e. lower with respect to a horizontal plane through the concentric middle axis m of the oxide remover, features, at least in a part thereof, a larger cross-section than in the upper part, i.e. the oxide deposit ring 40 exhibits asymmetry with respect to the concentric middle axis m of the oxide remover 30. An oxide deposit ring 40 of such a design, with an enlarged capacity in the lower part is particularly suitable for removing thixotropic metal alloy close to the oxide skin from the region close to the area on which it rests i.e. a region that exhibits higher viscosity than thixotropic metal alloy in the interior.

The longitudinal section through the oxide remover 30 shown in FIG. 2*b* also shows a cross-section of oxide deposit ring 40 which is particularly suitable for guiding the material that has been removed. The oxide remover opening 42 has the same shape as that of the oxide remover 30 shown in FIG. 2*a*.

Figure 3A:
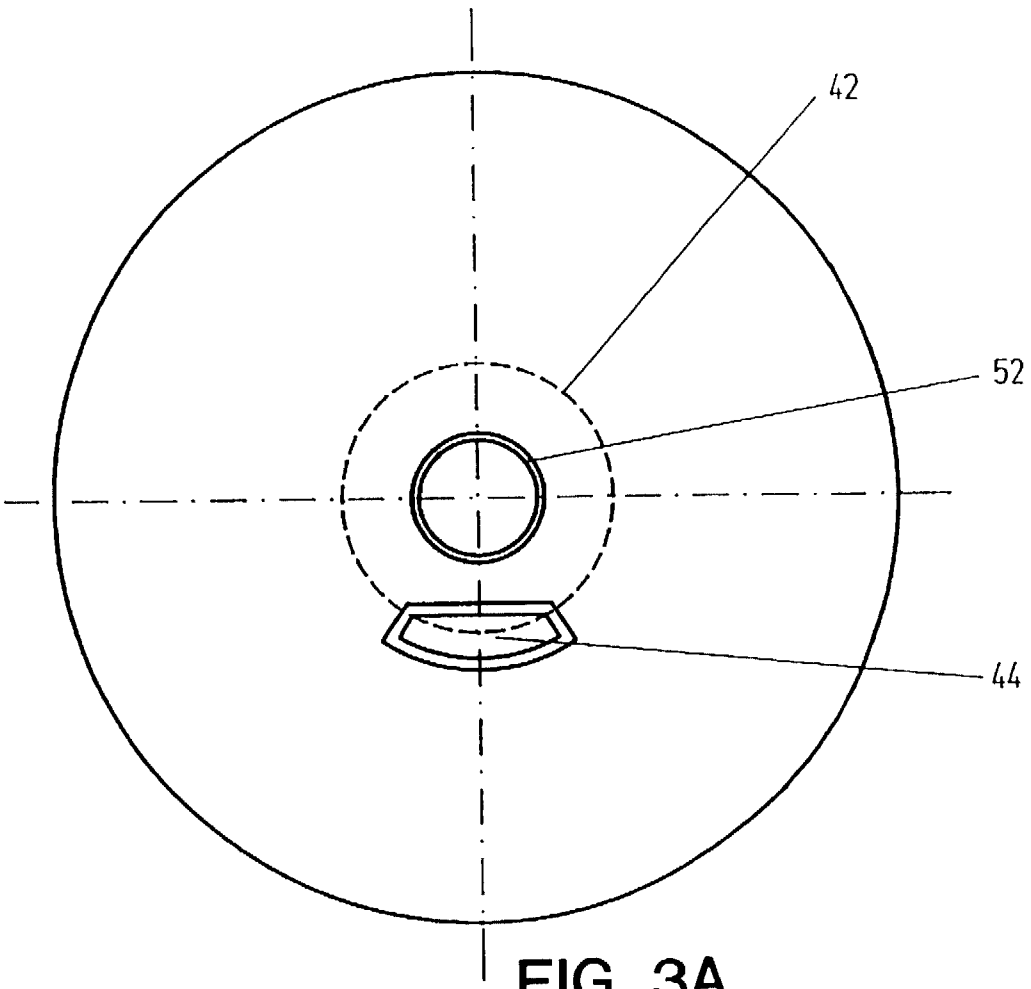
FIG. 3 shows a vertical longitudinal section through the concentric middle axis of an oxide remover lying against the fixed half of a mold and, at right angles to the concentric middle axis, a cross-section along the line A—A through the front side of the mold on the side towards the oxide remover.
Figure 3B:
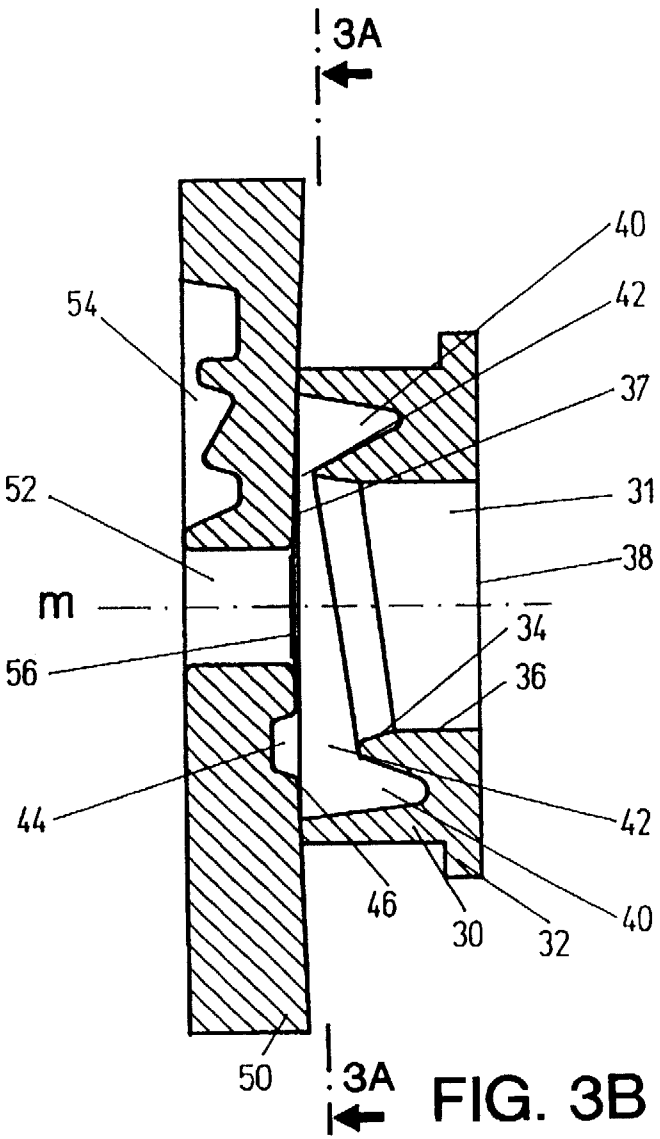

FIG. 3 shows a vertical longitudinal cross-section through the concentric middle axis m of an oxide remover 30 on a fixed half 50 of a mold 70 and a cross-section, along A—A at right angles to the concentric middle axis m, through the front side 46 of the mold 70 on the side facing the oxide remover 30. The recess 44 is preferably situated in the lower part of the oxide remover opening 42, i.e. lower with respect to the horizontal plane through the concentric middle axis of the oxide remover, and is arranged such that the cross-section of the opening in this lower region of the oxide remover opening 42 i.e. a segment of the hollow cylinder-shaped oxide remover opening 42, is enlarged. The recess 44 on the front side 46 of the mold 70 on the side facing the oxide remover 30 is provided in addition to an oxide remover opening 42 with a cross-section that is already asymmetric with respect to the concentric middle axis m of the oxide remover 30, and therefore enlarges the cross-section in this part of the oxide remover opening 42, and serves to provide better guidance of the oxide skin into the corresponding part of the oxide deposit ring 40.

The plan view shown in section A—A of the front side 46 of the mold 70 on the side facing the oxide remover 30 and the fixed mold half 50 shows in particular a preferred design of the recess 44 and its position with respect to the oxide remover opening 42 and the inlet 52. The recess 44 shown along line A—A in FIG. 3 concerns a segment of the oxide remover opening 42 which encloses an angle of about 65°.

Figure 4:
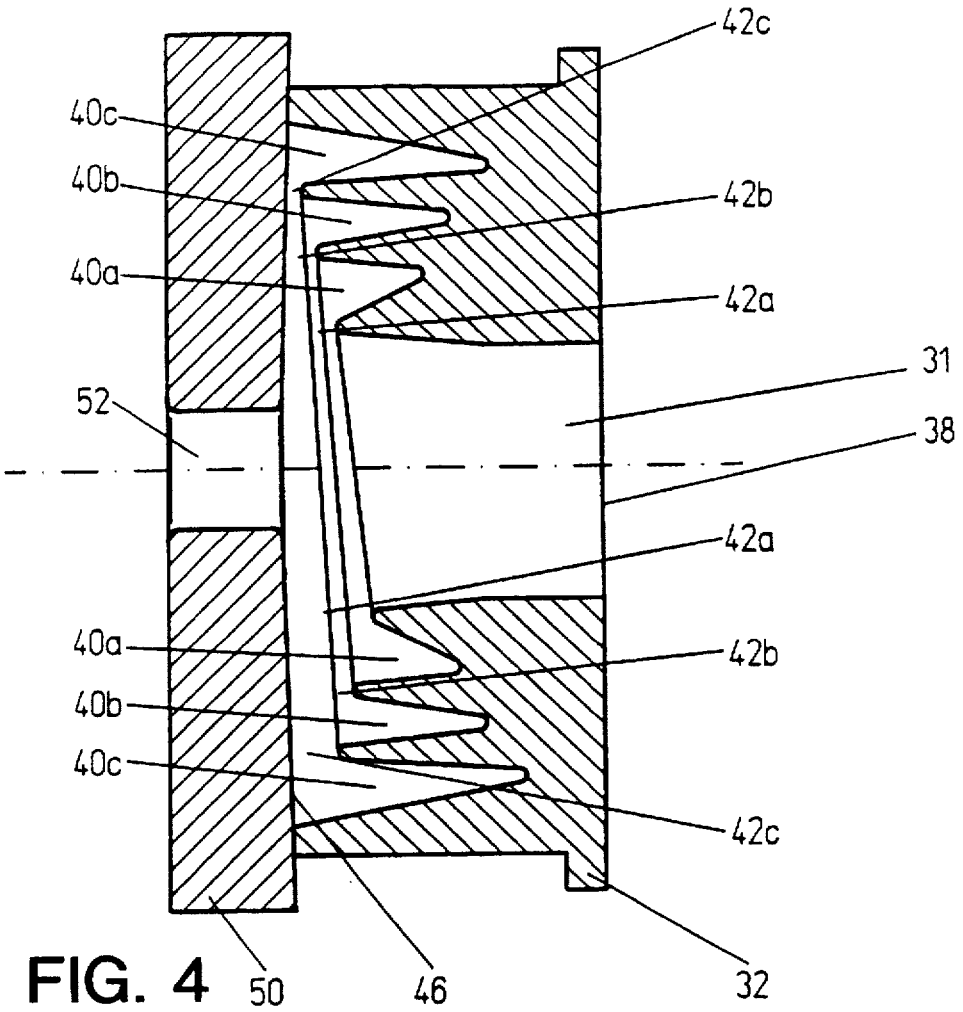
FIG. 4 shows a vertical longitudinal section through the concentric middle axis of an oxide remover lying against the fixed half of a mold, whose oxide deposit ring exhibits three oxide deposit ring chambers and three oxide remover openings for these.

FIG. 4 shows a vertical longitudinal cross-section through the concentric middle axis m of an oxide remover 30 resting against a fixed half 50 of a mold 70, the oxide deposit ring 40 of which exhibits three oxide deposit ring chambers 40*a*, 40*b*, 40*c* and the related oxide remover openings 42*a*, 42*b*, 42*c*, where the oxide deposit ring chambers 40*a*, 40*b*, 40*c* with respect to their capacity, and the oxide remover openings 42*a*, 42*b*, 42*c* with respect to their cross-section, are designed such that they permit optimal removal with respect to the pressure (p) arising in the thixotropic alloy during the thixoforming process, i.e. continuous and uniform removal over the whole peripheral region of thixotropic semi-solid alloy, of oxide skin and the thixotropic metal alloy close to the skin The oxide deposit ring chambers 40*a*, 40*b*, 40*c* are interconnected via their respective oxide remover openings 42*a*, 42*b*, 42*c*, i.e. an oxide remover opening 42*a*, to join the throughput opening 31 of the oxide remover 30 to the oxide deposit ring 40*a*, an oxide remover opening 42*b*to join the oxide deposit ring 40*a* to the oxide deposit ring 40*b*, and an oxide remover opening 42*c* to join the oxide deposit ring 40*b*, to the oxide deposit ring 40*c*. The oxide remover openings 42*a*, 42*b*, 42*c* are selected such that they permit continuous removal of the material to be removed during the three phases of the thixoforming process. Consequently, the ring-shaped oxide remover openings 42*a*, 42*b*, 42*c* exhibit an average cross-section that becomes smaller from inside towards the outside i.e. the average cross-section of the opening 42*a*, is larger than the average cross-section of opening 42*b*, which is larger than the average cross-section of opening 42*c*. By average cross-section of opening is meant here the cross-section taken as an average over the length of opening.

Figure 5:
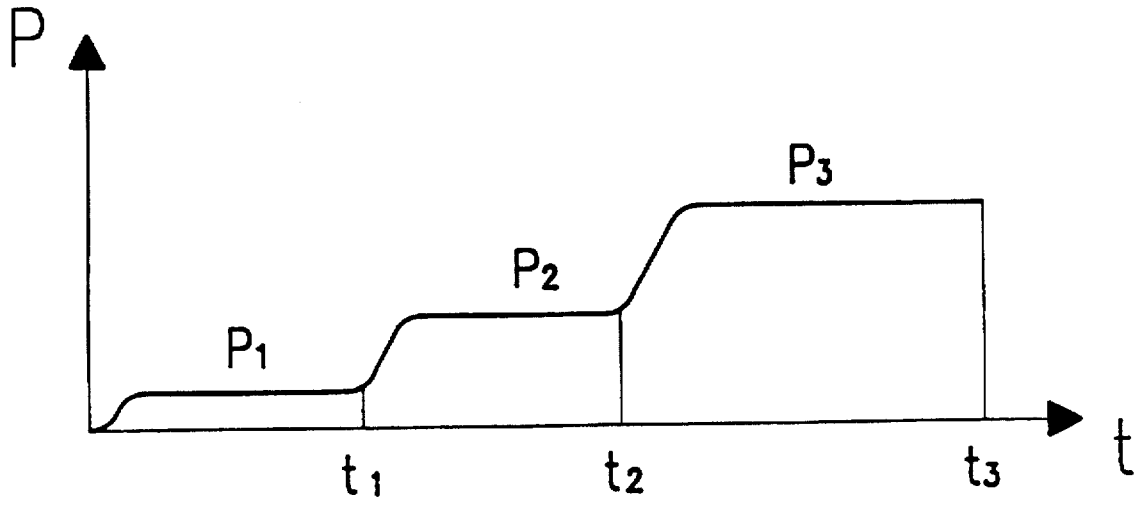
FIG. 5 shows by way of example a plot of the pressure p arising in the thixotropic metal alloy as a function of time during the thixoforming process.

FIG. 5 shows a schematic, diagrammatic example of the pressure p arising as a function of time t in the thixotropic metal alloy during the thixoforming process. In the first phase of the thixoforming process, up to time $t_1$ in the process, i.e. during the passage of the thixotropic, semi-solid alloy through the inlet opening and during the filling of the large-volume region of the mold space 68 bordering on the inlet opening 52, only a small pressure $p_1$ is built up in the semi-solid alloy, so that, in order to enable the material that is to be removed to pass through the oxide remover opening 42*a*, the latter opening must be of large cross-section. In a second phase of the thixoforming process, in the time interval between time $t_1$ and $t_2$ in the process, during the filling of the small volume space 68 in the mold or the mold regions with small cross-section, in particular regions at the extremities of the mold interior 68, the pressure p2 in the thixotropic semi-solid alloy usually rises suddenly, and the pressure applied to the thixo-billet has to be increased accordingly. In keeping with the higher pressure, the cross-section of the oxide remover opening 42*b* must be chosen such that it is smaller than that of 42*a* in order to ensure continuous and uniform removal of material. In a third phase of the thixoforming process, in the, time interval between $t_2$ and $t_3$ in the process, the pressure applied to the thixo-billet is increased further to a pressure $p_3$, this in order to fill e.g. regions of the mold interior 68 that are very small in cross-section, which for the third phase necessitates an oxide remover opening 42*c* of still smaller cross-section than the cross-section of opening required for the second phase. Thereafter, the pressure applied is normally increased further in order to prevent e.g. microvoids or pores from forming during the solidification stage. During the third phase of the thixoforming process, however, no further thixotropic material contributing to the product flows into the mold interior 68, so that during this phase oxide skin and thixotropic alloy close to the oxide skin need no longer be removed.

We claim:

1. Process for manufacturing shaped parts out of thixotropic metal billets in a horizontal pressure diecasting machine such that inclusions of the oxide skin surrounding the thixotropic metal alloy billet are avoided in the alloy structure of the shaped part, said diecasting machine including a casting chamber, a mold having a mold cavity and a ring-shaped oxide remover situated between the casting chamber and the mold, said oxide remover having a throughput opening, a concentric middle axis (m) and a concentric, ring-shaped oxide deposit ring that is connected to the throughput opening by a concentric, ring-shaped oxide remover opening which is asymmetrical with respect to the concentric middle axis (m) and is selected as a function of the viscosity properties of the thixotropic metal alloy such that removal of oxide-free, homogeneous thixotropic metal alloy is minimized, the process comprising: loading a thixotropic metal billet into said casting chamber; leading the metal alloy under pressure through the throughput opening of the oxide remover and into the mold cavity; including the steps of passing the oxide skin surrounding the metal billet through said oxide remover opening and collecting said oxide skin in said oxide deposit ring.

2. Process according to claim 1, including the step of removing part of the metal alloy of the thixotropic metal billet along with the oxide skin.

3. Process according to claim 1, wherein the oxide remover opening, which is asymmetric with respect to the concentric middle axis (m), is selected in such a manner that a radial uniform thick layer of oxide skin and the thixotropic metal close to the oxide skin is removed.

4. Process according to claim 1, wherein part of the thixotropic metal alloy in the casting chamber which originates from the part of the metal billet near a contact surface, and has higher viscosity than the rest of the thixotropic semi-solid alloy, is removed along with the oxide skin.

5. Process according to claim 1, wherein the removal of the oxide skin takes place through the whole thixoforming process, so that the amount of material removed per unit time is proportional to the rate of advance of the thixotropic metal billet.

6. Apparatus which comprises: a horizontal pressure diecasting machine for manufacturing shaped parts out of thixotropic metal billets such that inclusions of the oxide skin surrounding the thixotropic metal billet are avoided in the alloy structure of the shaped part, said horizontal pressure diecasting machine including a horizontal casting chamber with a cylindrical shaped hollow interior to accommodate a thixotropic metal billet, a backup plate with opening therein, a mold with inlet opening and mold cavity, and an oxide remover situated between the casting chamber and the mold; wherein the oxide remover represents a ring-shaped body with a horizontal, concentric middle axis (m) and an outer and inner face; and wherein the inner face represents the boundary of a throughput opening; said oxide remover having a concentric, ring-shaped oxide deposit ring therein that is connected to the throughput opening by a concentric, ring-shaped oxide remover opening which is asymmetrical with respect to the concentric middle axis (m) and is selected as a function of the viscosity properties of the thixotropic metal alloy such that removal of oxide-free, homogeneous thixotropic metal alloy is minimized.

7. Apparatus according to claim 6, wherein the concentric middle axis (m) of the oxide remover is coincident with a concentric middle axis of the inlet opening of the mold and coincident with a concentric longitudinal axis of the cylindrical shaped hollow interior of the casting chamber.

8. Apparatus according to claim 6, wherein a cross-section through the throughput opening perpendicular to the concentric middle axis (m) defines the cross-sectional area of the throughput opening which corresponds to that of the cylindrical shaped hollow interior of the casting chamber.

9. Apparatus according to claim 6, wherein the ring-shaped oxide remover opening is at least in part formed by a recess in the oxide remover on the mold side.

10. Apparatus according to claim 6, wherein at least a part of a lower part of the oxide remover opening which is lower than a horizontal plane through the concentric middle axis (m), has a larger opening cross-section than an upper part thereof.

11. Apparatus according to claim 9, wherein the oxide remover opening is on the mold side face of the oxide remover, a recess is provided in the front face of the mold on the side facing the oxide remover, such that at least a part of the cross-section of the oxide remover opening is enlarged in a lower part with respect to a horizontal plane through the concentric middle axis (m) of the oxide remover.

12. Apparatus according to claim 11, wherein the recess is at least one of cylindrical, barrel and blunted pyramid in shape.

13. Apparatus according to claim 11, wherein a vertical plane through the concentric middle axis (m) of the oxide remover, the recess exhibits a maximum height of 10 to 40 mm and a maximum breadth 20 to 80 mm and, in the direction of the middle axis (m) a maximum depth of 2 to 20 mm.

14. Apparatus according to claim 6, wherein the oxide deposit ring includes a plurality of ring-shaped recesses, which are oxide deposit ring chambers, with a common concentric middle axis (m) which coincides with the concentric middle axis of the oxide remover and the oxide deposit ring chambers are joined to each other, each via an oxide remover opening.

15. Apparatus according to claim 14, wherein the shape of the oxide deposit ring chambers and the oxide remover openings are designed such that they permit, with respect to the pressure (p) arising in the thixotropic alloy during the thixoforming process, optimal removal of the oxide skin and the thixotropic metal alloy close to the skin.

16. Apparatus according to claim 6, wherein the oxide deposit ring contains 1 to 5 oxide ring chambers and a corresponding number of oxide remover openings.

17. Apparatus according to claim 6, wherein at least a part of the oxide deposit ring lower than a horizontal plane through the concentric middle axis (m) of the oxide remover, has a larger cross-section than an upper part.

18. Apparatus according to claim 17, wherein the oxide deposit ring is such that, in a vertical section along the middle axis (m) of the oxide remover, the lower section of the oxide deposit ring exhibits an area that is 1 to 3 times larger than that of the upper section of the oxide deposit ring.

19. Apparatus according to claim 17, wherein the oxide deposit ring is such that, in a vertical section along the middle axis (m) of the oxide remover, the lower section of the oxide deposit ring exhibits an area that is 1.1 to 1.8 times larger than that of the upper section of the oxide deposit ring.

* * * * *